United States Patent [19]

Richardson et al.

[11] Patent Number: 4,472,067

[45] Date of Patent: Sep. 18, 1984

[54] CHESS CLOCK

[75] Inventors: Donald M. Richardson, 1612 N. Hill Ave., Pasadena, Calif. 91104; Greg DeSmet, Pasadena, Calif.

[73] Assignee: Donald M. Richardson, Pasadena, Calif.

[21] Appl. No.: 410,398

[22] Filed: Aug. 23, 1982

[51] Int. Cl.[3] ..... G04F 3/00

[52] U.S. Cl. ..... 368/96; 368/187

[58] Field of Search ..... 368/82, 96, 107–113, 368/185–188

[56] References Cited

U.S. PATENT DOCUMENTS

| | | | |
|---|---|---|---|
| 4,036,008 | 7/1977 | Okamoto et al. | 368/187 |
| 4,062,180 | 12/1977 | Meshi et al. | 368/96 |
| 4,079,583 | 3/1978 | Larsen | 368/96 |
| 4,083,176 | 4/1978 | Higashi | 368/187 |
| 4,092,822 | 6/1978 | Digoz et al. | 368/187 |
| 4,177,632 | 12/1979 | Burki et al. | 368/187 |

*Primary Examiner*—Vit W. Miska

*Attorney, Agent, or Firm*—John E. Wagner

[57] ABSTRACT

A game timing device for simultaneously timing events for two players comprising clock means for counting the time of two different events a pair of start switches, each for initiating the operation of the clock means for counting one of the two different events and for interrupting the count of the other of the two different events;

display means coupled to the clock means for displaying the time for each of the two events;

reset switch means for resetting the clock means to a predetermined initial value;

advancing switch means for advancing the clock means at a faster than normal rate;

counter means coupled to the respective ones of the pair of switches for counting the number of operations of respective ones of the pair of start switches; and means coupling the clock means to the display means for normally displaying time in one set of units and means responsive to a predetermined time count by the clock means for displaying the time count in shorter units of time.

14 Claims, 5 Drawing Figures

CHESS CLOCK

BACKGROUND OF THE INVENTION

In tournament game competition such as chess, the game when played without time restraints becomes impractical. Consequently, most tournaments allocate to each player a total number of minutes allowed for the total game or a portion thereof, with the allocation of time for individual moves left to the players. This type of play requires a clock for each player and provisions for starting and stopping each player's clock. Clocks operate alternately and often provide an alarm or indication when a player's total time has elapsed. This has been accomplished in the past employing two mechanical clocks, in one cabinet for both players, and interconnected to stop one clock and start the other simultaneously. This is accomplished as a player who completes a move strikes a button which stops his clock and starts his opponent's clock. More recently, rather complex electronic clocks have been developed as is illustrated by U.S. Pat. No. 4,062,180 which is notable for its complexity from a player's standpoint and is of such size as to possibly be a distraction for the players. A continuing need exists for a small portable chess clock having a minimum number of controls which are clearly apparent in purpose and simple to operate.

A display using liquid crystal (LCD) rather than light emitting diodes (LEDs) is preferred since the latter requires the player to recharge or replace his power source every few hours of play. The possibility of power loss during play of an important game is a constant concern with prior art electronic chess clocks. With LCDs two inexpensive penlight batteries allow dependable operation for 12 to 15 months. It is therefore an object of this invention to employ such LCDs and power sources. Versatility in the chess clock to allow it to be easily used for games of different length and rules is desirable as well.

BRIEF DESCRIPTION OF THE INVENTION

We have developed a game clock designed particularly for use in tournament chess competition. The clock is battery powered, portable, employing crystal controlled timing and all solid state circuitry as well as near silent switches and liquid crystal displays. The clock of our invention becomes small in size, quiet, unobtrusive yet precisely accurate and significantly more flexible to accommodate different types of tournaments. As an example of the flexibility of the clock of our invention, it allows for display of hours and minutes during the major period of the game but as it approaches the final minutes, it automatically shifts to a minutes-and-seconds mode to provide more precise information for the player approaching the end of his playing time. As a further mode of operation, the clock may be set to any game length desired up to 9 hours, 59 minutes and at the end of that period for either player, the clock automatically resets and begins timing an overtime period while giving a visual indication of the commencement of overtime for that player. No disturbing sounds are emitted from the clock at any time.

Our invention is embodied in a solid-state logic circuit employing a pair of crystal-controlled oscillators defining time bases for two timing operations, one for each player. Divider chains for each clock divide the output of the oscillators to produce second, minute and hour signal outputs. A pair of registers, one for each clock, labeled the A clock and the B clock, store the original starting time, e.g. 1 hour and subsequent time changes. The registers are coupled through decoder/-driver circuits to respective three numeric display zones of a common six or greater numeral display device such as a liquid crystal display.

A pair of manual switches, one operated by player A and the other by player B are coupled via start/stop time base switching logic for stopping the A clock operation and starting the B clock operation when the A switch is operated and the A clock is running. Similarly, the start/stop time base circuit stops the B clock and starts the A clock whenever the B manual switch is operated while the B clock is running. An additional set of registers count the number of clock enable operations of each switch. Our invention also includes an auxiliary switch which is actuated momentarily to allow the display of the number of moves by each of the two players to resolve any dispute or confusion. The display automatically returns to time display after release.

BRIEF DESCRIPTION OF THE DRAWING

A more complete understanding of this invention may be had from the following detailed description and by reference to the drawing in which.

DETAILED DESCRIPTION OF THE INVENTION

Figure 1:
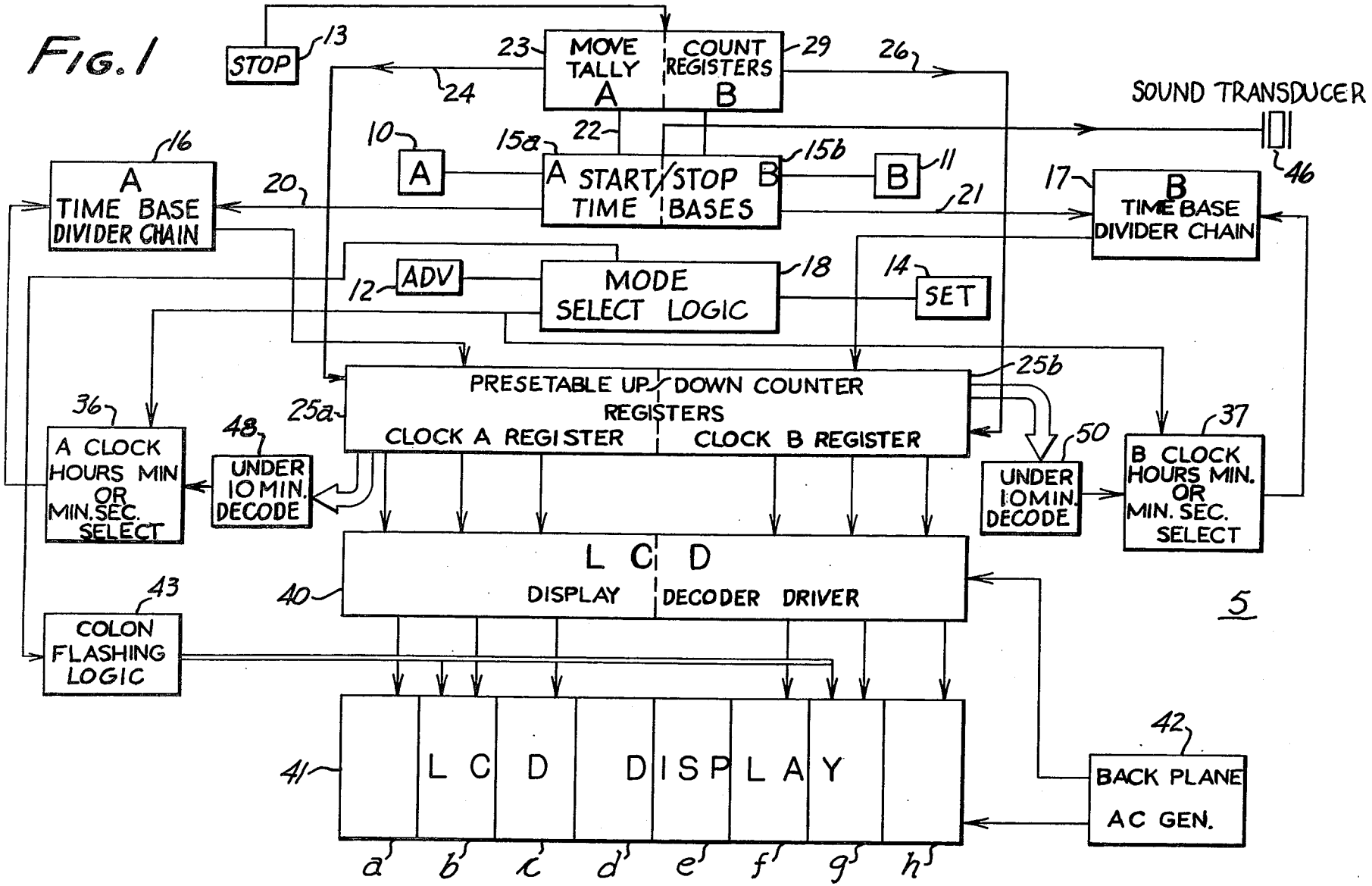
FIG. 1 is a functional block diagram of this invention.
Figure 2A:
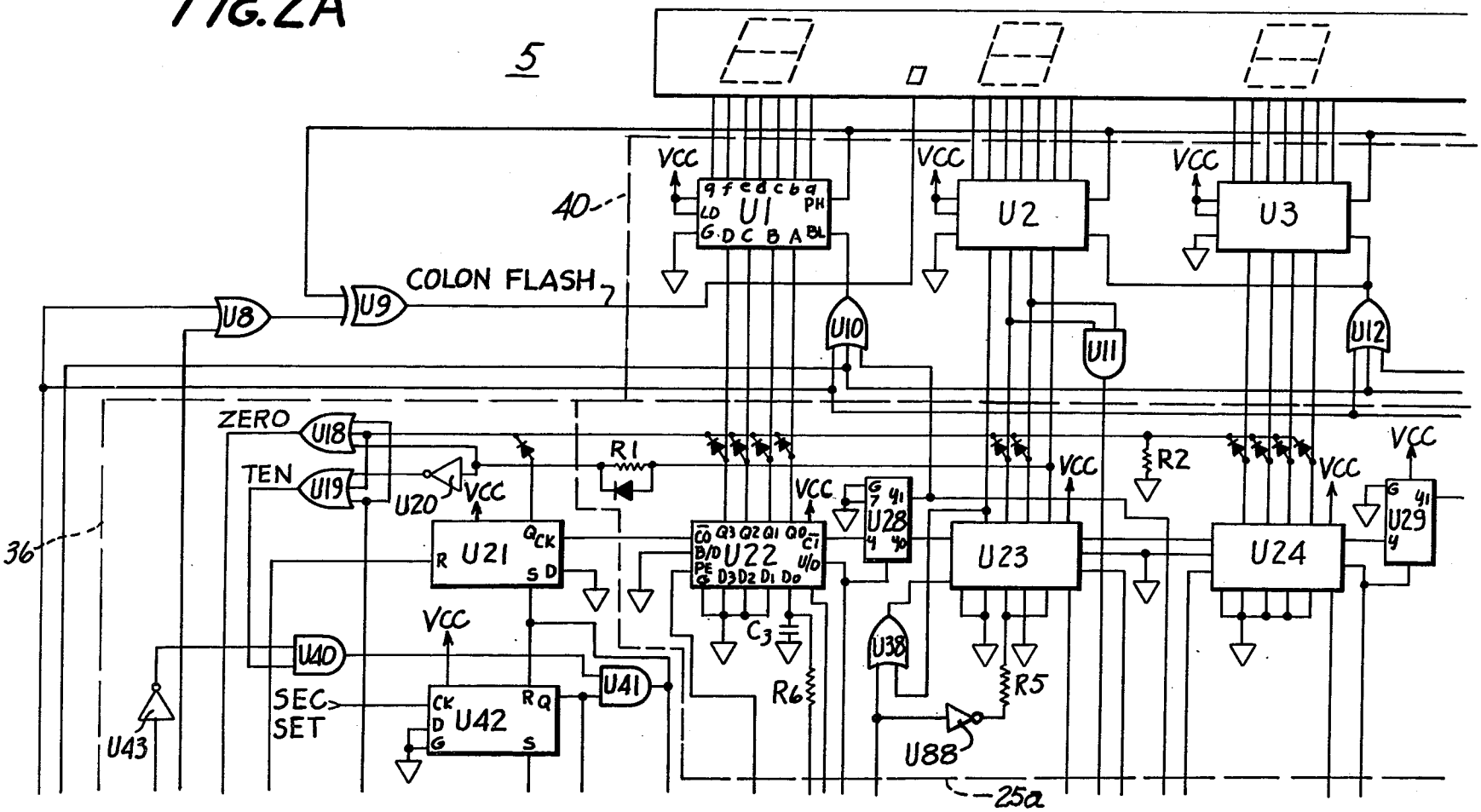
FIGS. 2A, 2B, 2C, and 2D are an electrical schematic diagram of this invention.
Figure 2B:
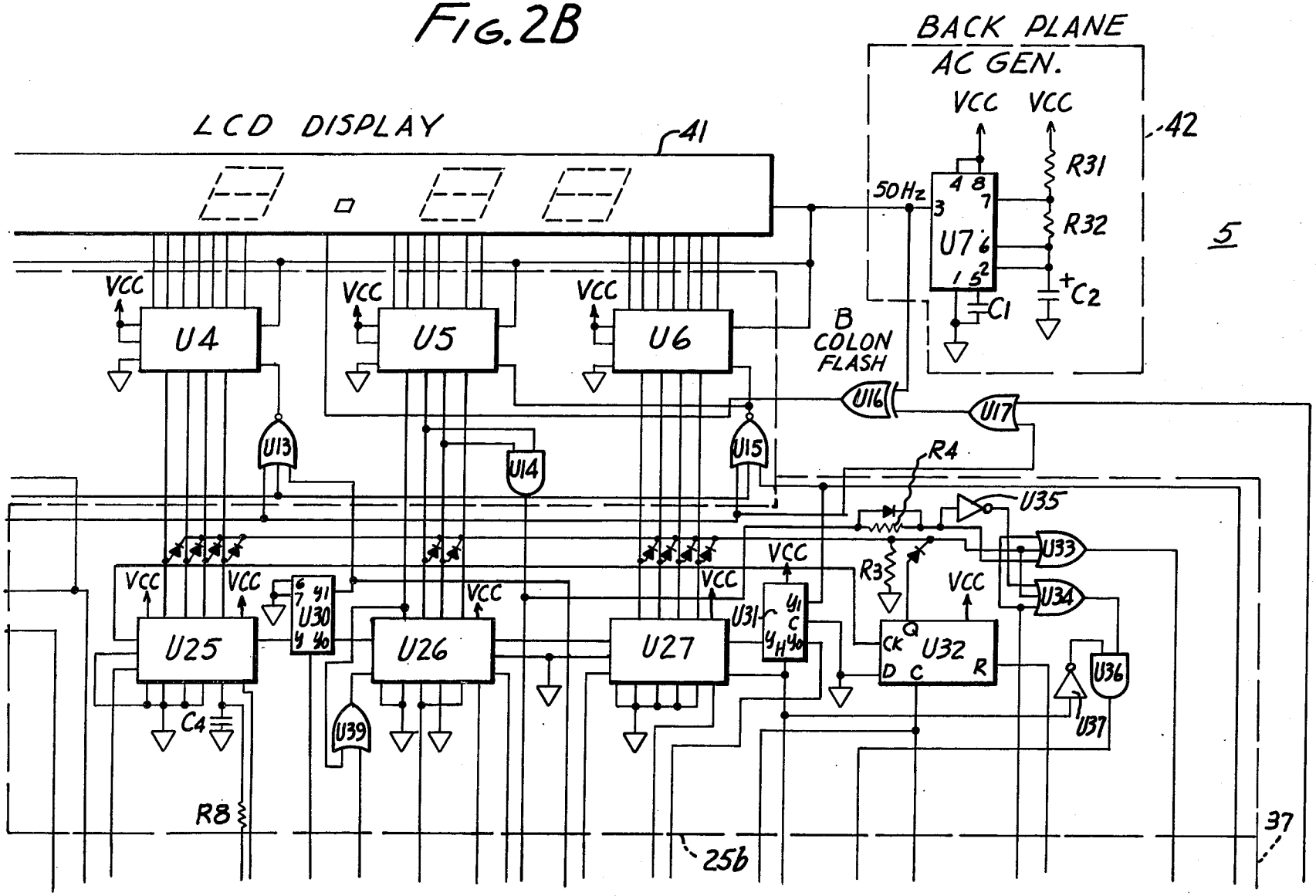
Figure 2C:
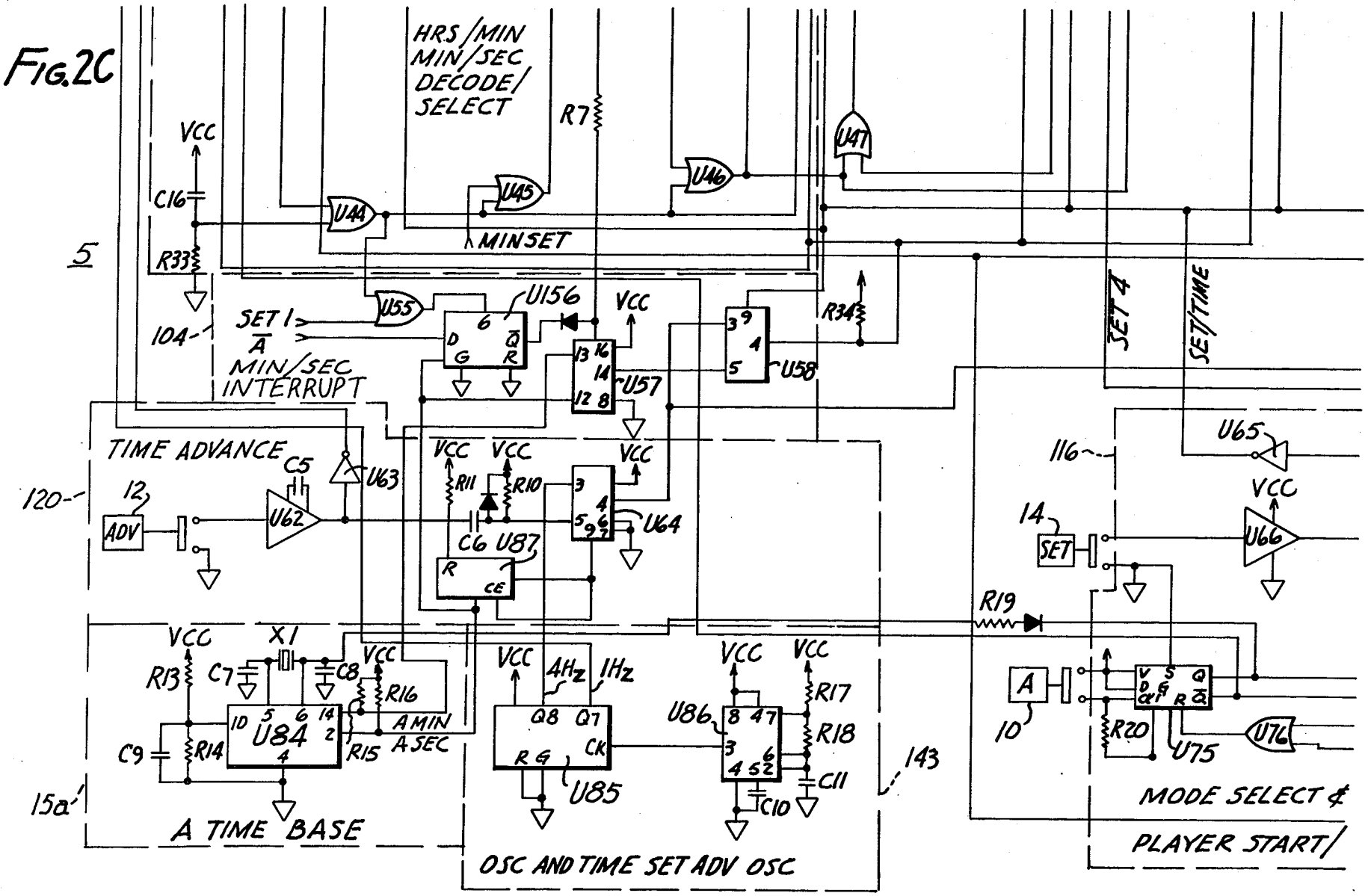
Figure 2D:
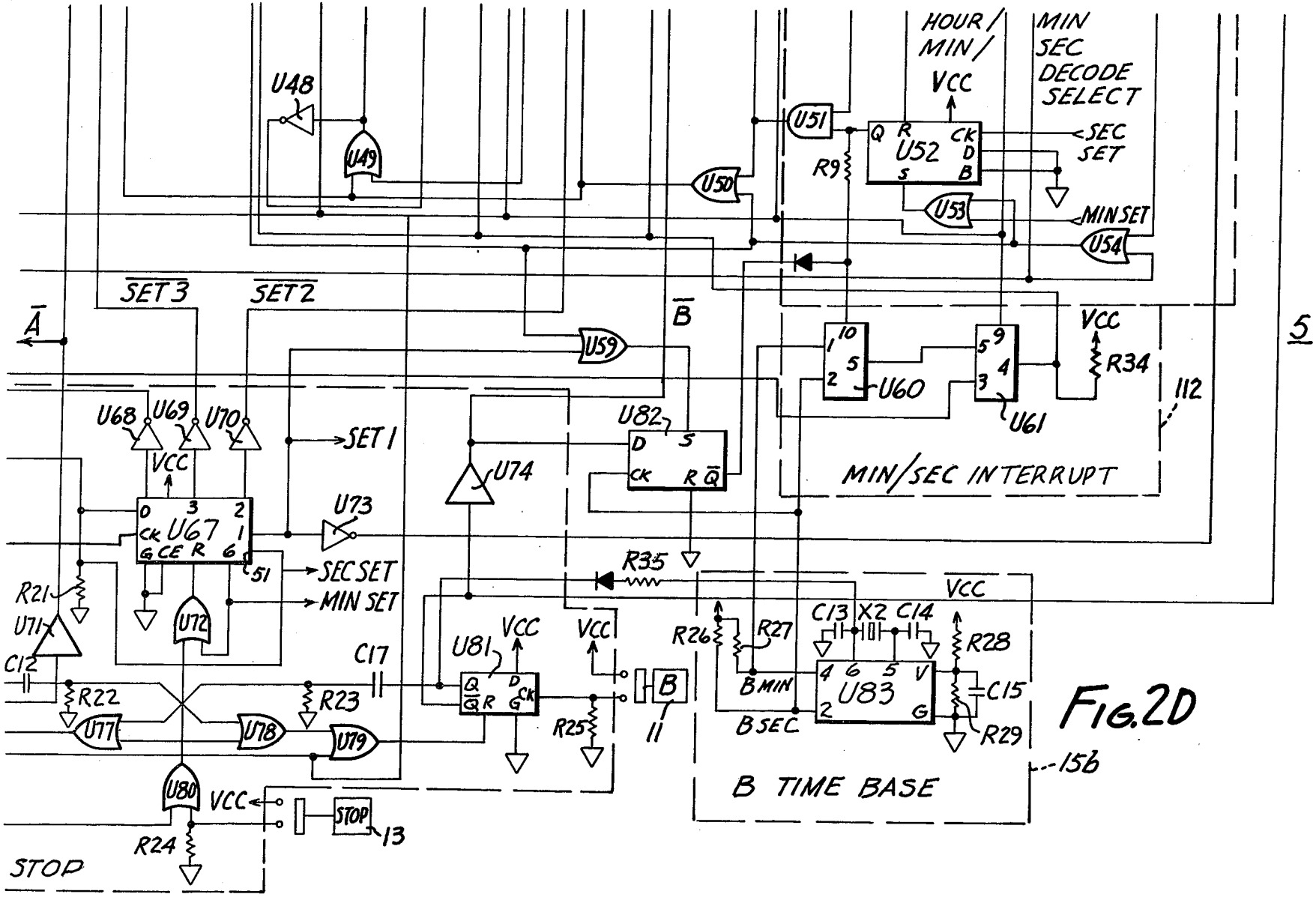

In most timed chess matches or tournaments, the time for each player is divided into periods, a primary period and additional secondary periods. The primary period is typically 2 hours long and each player is expected to have completed at least 40 moves in this 2 hour primary period. If one player does not complete his 40 moves within the 2 hour primary period, he will lose automatically.

The primary period is typically followed by secondary periods typically of 1 hour duration which last until the game is over. However, any time remaining to a player by virtue of being left over from the primary period is to be credited as extra time in any secondary periods. Of course, time only runs against a player while it is his turn to move and runs from the moment it is his turn until he makes his move.

There are many different time periods which are being used in competive chess which range from 2 hour primary periods with 1 hour secondary periods to 10 minute complete games.

Referring to FIG. 1, the chess clock 5 of the present invention sets primary and secondary periods for each player and subtracts each player's time used from the primary and/or secondary periods of the chosen game format. The chess clock 5 credits a player with his unused time in the primary and secondary periods. The chess clock 5 credits this unused time by continuing a count down of the primary period until it ends, regardless of how many moves have been completed, and then automatically resets itself for the standard 1 hour secondary period. Thus, each player will receive his unused time after his 40th move as the remaining time of the primary period.

The chess clock 5 also automatically starts new secondary periods when the primary period has ended.

The chess clock 5 does this by automatically resetting a secondary period of 1 hour (an international standard secondary period) if the game period was set to other than 5 minutes or 30 minutes. The 5 and 30 minute game periods are standard game periods which have no secondary period. In the case that either of the 5 or 30 minute standard game periods is chosen, the chess clock 5 simply resets itself for the game period last chosen.

The chess match environment necessitates that a device for keeping time be extremely simple to operate with displays which are unobtrusive. The player must be able to operate the device for keeping time without looking up from the game or losing even the slightest concentration. Consistent with these requirements, the chess clock 5 uses noiseless switches 10, 11, 12, 13 and 14 with large surface areas which can be found by the player without the distraction of looking up from his game. The switch placement and the relative size of the switch surface area is illustrated in design patent application Ser. No. 273,857 filed June 15, 1981 to which reference is hereby made and the disclosure of which is hereby incorporated by reference. As will be described later, the display 41 of the chess clock 5 is typically of the liquid crystal type which casts no light of its own into the game area. Thus, the display 41 does not interfere with the concentration which must be exercized by each player in a chess match or tournament.

Control switches 10, 11, 12, 13 and 14 for the chess clock 5 are easily switched with light finger pressure. As an indication to the players that a move has been completed and that the chess clock 5 is now running against the other player, the chess clock 5 preferrably will emit a low level tone burst coincident with a start/-stop switching by one of the players. Although sounds coming from any source are frowned upon by tournament players, this low level "beep" will gently alert the players that the start/stop switching has been made; thus, there will be a savings for each player because there is no need for a break in concentration necessary to look up at the time remaining display and because valuable time will not be wasted determining whether a start/stop switching has occurred against a particular player.

Preferred Embodiment

The preferred embodiment of the chess clock 5 is shown in FIG. 1 in electrical block diagram form. Start/stop switches 10 and 11 are the switches used by player A and player B respectively to indicate that a move has been completed, to stop the time running against the player who has completed his move and to start the time running against the other player. These start/stop switches 10 and 11 are pressure sensitive switches with relatively large surface areas which can be easily found by a player without looking up to find their location. When one of the start/stop switches 10 or 11 is depressed, a start/stop time base 15*a* or 15*b* will be stopped and the opposite start/stop time base 15*a* or 15*b* will be started. Preferably, an indication of the switching of either one the start/stop switches 10 and 11 will be made audible through sound transducer 46 as a low level audio tone to alert each player that a switching has been made.

Signals from the start/stop time bases 15*a* or 15*b* will cause the presetable up/down counters 25*a* or 25*b* to start a count down or stop a count down through time base divider chains 16 and 17, respectively. The mode select logic 18 together with ADVANCE switch 12 and SET switch 14 will select the time period for the game and control the colon flashing logic circuit 43 which causes indications on the LCD display 41 which allow the user to easily understand which figures on the display are being reset. The typical indication is a flashing of the digits to be reset. The mode select logic 18 will also allow indications of whether the game is stopped for some reason and how many moves have been made by each player.

The tally of moves by each player is stored in move tally circuit 23 and count registers 29 which receive signals from the start/stop time bases 15*a* and 15*b* which, in turn, indicate a single switching of start/stop switches 10 and 11, respectively. The tally from each of the tally circuit 23 and count registers 29 will be communicated to the presetable up/down counter registers 25*a* and 25*b* respectively for display on LCD display 41 under the control of the mode select logic 18 and ADVANCE switch 12. Depressing STOP switch 13 during a match will cause the holding of the tallys in each of the tally circuit 23 and count registers 29 and will cause the count downs occurring in presetable up/down counter registers 25*a* and 25*b* to stop. Another depressing of either of the start/stop switches 10 or 11 will cause the remaining time periods of the match to resume where they left off.

If the time set in the presetable up/down counter registers 25*a* and 25*b* is 10 minutes or less, the 10 minute decode circuits 48 and 50 will cause the A clock select and B clock select circuits 36 and 37 respectively to cause the display 41 to display the time remaining for each player in minutes and seconds. If a time larger than 10 minutes is chosen, the A clock select and B clock select circuits 36 and 37 will automatically cause the hours and minutes to be displayed. The A clock select and B clock select circuits 36 and 37 control the time base divider chains 16 and 17 respectively which cause the display of either the minutes and seconds or the hours and minutes.

The LCD display 41 is driven from presetable up/-down counter registers 25*a* and 25*b* by LCD display driver/decoder 40 and back plane A.C. generator 42. Typically, in the preferred embodiment, only digits 41*a–c* and 41*f–g* are used since games rarely are set to run for more than 9 hours and 59 minutes.

Operation of the Preferred Embodiment

The preferred embodiment of the chess clock 5 may be operated in accordance with the following instructions. Since the preferred embodiment has no power switch, the first step is to press the STOP switch 14 for at least 1.25 seconds to cause the display of the digits 41*a–c* and 41*f–h*. The next steps are those necessary to set the game period:

1. Press the SET switch 14. The minutes digits 41*g* and 41*h* of the right hand display (player B's clock display) will begin flashing. Press the ADVANCE switch 12 until the minute digits 41*g* and *h* of the right hand display are correct for the chosen game period. (Holding the ADVANCE switch 12 down for more than 1 second will cause the flashing numbers to go into a more rapid advance).

2. Press the SET switch 14 again; this will cause the hours digit 41*f* of the right hand display to flash. Press the ADVANCE switch 12 until the hours digit is correct for the chosen game period.

3. Press the SET switch 14 again, this will cause the minutes digits 41*b* and 41*c* of the left hand display (A's time display) to begin flashing. Press the ADVANCE switch 12 until the minutes correspond to the correct game period minutes.

4. Press the SET switch 14 again; this will cause the hour digit 41*a* of the left hand display to begin flashing. Press the ADVANCE switch 12 until the hours digit corresponds to the correct hours digit of the chosen game period. Next, press the SET switch 14 and then the STOP switch 14 to ready the chess clock 5 for counting down.

If any mistake is made, press the STOP switch 14 and start the above procedure over again. Once all 6 digits of the chess clock 5 have been set, it is ready to start counting down after pressing the STOP switch 14. Whomever is the player to have the first move should have his opponent press his start/stop switch 10 or 11 and the player with the first move will have his down counting begun. Pressing the STOP switch 14 thereafter will freeze both counts in case a rest period is desired. When the rest period is over, the player who was to move next has his opponent press his start/stop switch 10 or 11 to start the count down for the player with the next move.

To display the number of moves which each player has made, simply press the ADVANCE switch 12 without first pressing the SET switch 14 and the number of moves will be displayed for the period that the ADVANCE switch 12 is depressed.

If a 5 minute or 30 minute game period was chosen in the above setting steps, then the chess clock 5 will automatically reset the game period to the originally set game period. If any other game period is chosen, then a series of 1 hour secondary periods will be automatically reset after the expiration of the primary period originally set. Also, if the game period is set to 10 minutes or less, the display 41 will display minutes and seconds. In all other chosen game periods, the display 41 will display hours and minutes.

If stop switch 13 is momentarily pressed, the timing down of the currently operating clock is stopped, so that the time in both is held for the purpose of adjournment of a game or adjudication of disputes or other interruption. The current timing and move count of both players is maintained.

To resume play, either start switch, when operated, will resume the countdown of time. Normally, the nonmoving player would operate his start switch 10 or 11 to resume play and to resume countdown of his opponent's clock just as before the adjournment.

To turn off the display, simply depress the STOP switch 13 for at least 1.25 seconds and the display will disappear. The timing of both clocks and move count remains stored in memory to be recalled to view by pressing stop switch 13 for longer than 1.25 second and the display will return. If, however, player switches 10 and/or 11 have been activated at least once as in the progress of a game, then pressing the stop switch 13 will simply place the timing of both players on hold. If the players decide not to resume play at once, they may store their respective times and mover count in memory by pressing the SET switch 14 and then pressing the STOP switch 13 for longer than 2 seconds. This will put the time in memory so that accidental pressure on playing switches 10 or 11 will not alter the times indicated prior to resumption of play. When play is to resume, the stored time can be brought back to view simply by depressing the STOP switch by longer than 1 second.

Logic Embodiment

Referring to FIGS. 2*a*–2*d*, a logic embodiment of the chess clock 5 is shown. Several of the functional blocks from the preferred embodiment are similar to the functional blocks identified in the logic embodiment.

Mode select and player start/stop circuit 116 is composed of integrated circuits U65-080, STOP switch 13, start/stop switches 10 and 11, SET switch 14 and associated components. The mode select and player start/stop circuit 116 controls start/stop time bases 15*a* and 15*b* to turn on or off depending on whether it is player A's turn or player B's turn, respectively. The SET switch 14 causes a set mode to exist which is intended, to allow a change in the game period which may be expressed in minutes and seconds or hours and minutes for both players. Each time the SET switch 14 is depressed, released and depressed again, a different minutes or hours figure on the time display may be set. STOP switch 13 causes the start/stop time bases 15*a* and 15*b* to stop, thus freezing the count down existing in the presetable up/down counter registers 25*a* and 25*b*. Subsequent depressing of either of the start/stop switches 10 or 11 will cause the count down to continue in the presetable up/down counter registers 25*a* or 25*b*.

When the chess clock 5 is to be set to a particular time period for a game, the SET switch 14 and then the ADVANCE switch 12 in the time advance circuit 120 are depressed. This causes the divider and time set advance oscillator circuit 143 to up count the presetable up/down counter registers 25*a* or 25*b* depending on which one is chosen by the mode select and player start/stop circuit 116. The A and B clock select/decode circuits 36 and 37 normally cause the presetable up/down counter registers 25*a* and 25*b* to count in hours and minutes. However, when the chess clock 5 is set for 10 minutes or less, the min/sec decode circuits 104 and 112 detect time of less than 10 minutes causing the presetable up/down counter registers 25*a* and 25*b* to count down and display the game period in minutes and seconds instead of hours and minutes.

Similar to the preferred embodiment, the logic embodiment has LCD display decoder/drivers 40 and back plane A.C. generator 42 to allow the LCD display 41 to display the digits of the game period or to display the move tally as the case may be. The logic embodiment can be powered by any conventional power source supplying approximately 3 to 5 volts.

The following is a listing of the components use in the logic embodiment of the present invention:

Intergrated Circuits

U1–U6 are MC14543 manufactured by Motorola, or Equiv. U7 and U86 are both ICH 7555 manufactured by Intersil or Eqiv. U8, U44–U47, U55 U38, U17, U50, U53, U54, U49, U59, U72, U78, U77, U76, U77, and U80 are 74C32's manufactured by National Semiconductor Corporation of Sunnyvale, Calif. or Equiv.

U21, U42, U56, U32, U52, U82, U81 and U75 are all CD4013's manufactured by Radio Corporation of America (RCA) or Equiv.

U28–U31, U60, U61, U64, U57 and U58 are all CD4053's manufactured by Radio Corporation of America (RCA) or Equiv.

U67, U88, U48, U37, U73, U65, U68, U69, U70 and U63 are all 74CO4's manufactured by National Semi Conductor Corporation or Equiv.

U85 is a 4042 manufactured by RCA or Equiv.

U40, U41, U11, U14, U36 and U51 are all 74CO8's manufactured by National or Equiv.

U66, U74, U62 and U71 are all MC14490 manufactured by Motorola or Equiv.

U10, U12, U13, U15, U33, U34, U18, and U19 are all 4025's manufactured by RCA or Equiv.

U84 and U83 are both ICM/7213IPD's manufactured y Intersil.

U22–U27 are all CD4029's manufactured RCA or Equiv.

Resistors

R1, R4, R8, R6, R5, R9 are 5.1 kilo ohms ¼ watt. R2, R3, R10, R11, R15, R16, R19–R23, R25–R27, R30, R32–R34 are all 10 kilo ohms ¼ watt. R13 and R28 are both 2.2 kilo ohms ¼ watt. R14 and R29 are both 3.5 kilo ohms ¼ watt. R17 and R31 are both 1 kilo ohms ¼ watt. R18 is 47 kilo ohms ¼ watt.

Capacitors

C1, C3, C4–C6, C9, C10, C12, C15 and C17 are all 0.01 microfarads.

C7, C8, C13 and C14 are all 30 pico-farads.

C2 and C11 are both 1 microfarad.

C16 is 22 microfarad.

Diodes

All diodes shown in FIGS. *2a–2d* are all IN914 diodes.

Crystals

X1 and X2 are both 4.194304 Mhz crystals.

The above described embodiments are illustrative of the present invention and should not be considered limiting. Instead, the scope of the present invention shall be described in the following claims and their equivalents.

What is claimed is:

1. A game timing device for simultaneously timing events for two players comprising;

clock means for measuring the time of two different events;

a pair of start switches, each for initiating the operation of said clock means for timing one of said different events and for interrupting the timing of the other of said two different events;

display means coupled to said clock means for displaying the time for each of said two events;

counter means coupled to said respective ones of said pair of switches for counting the number of operations of respective ones of said pair of start switches; and means coupling said clock means to said display means for normally displaying time in one set of units and means responsive to a predetermined time count by said clock means for displaying the time count in shorter units of time;

wherein said clock means comprises a pair of individual clocks and each of said pair of start switches is coupled to said individual clocks to start one of said individual clocks to start one of said individual clocks while simultaneously stopping the other of said individual clocks;

including means responsive to completion of counting of one of said events by one of said individual clocks for automatically displaying the number of operations of the switch controlling the other of said individual clocks.

2. A game timing device for simultaneously timing events for two players comprising;

clock means for measuring the time of two different events;

a pair of start switches, each for initiating the operation of said clock means for timing one of said different events and for interrupting the timing of the other of said two different events;

display means coupled to said clock means for displaying the time for each of said two events;

counter means coupled to said respective ones of said pair of switches for counting the number of operations of respective ones of said pair of start switches; and means coupling said clock means to said display means for normally displaying time in one set of units and means responsive to a predetermined time count by said clock means for displaying the time count in shorter units of time;

whereby said display means comprises a single multi-digit display with certain of the digits of said display controlled by one of said pair of start switches and the other of said digits of said display controlled by the second of said pair of start switches;

including common SET switch and means for in sequence setting each of the digits of said display to predetermined values;

including means responsive to a predetermined number of operations of said SET switch for converting said display thereafter to display of time in said shorter units of time thereafter.

3. The combination in accordance with claim 2 including means responsive to operation of said SET switch means a different predetermined number of times for reconverting said display to displaying time in said longer units of time.

4. A game timing device for simultaneously timing events for two players comprising;

clock means for measuring the time of two different events;

a pair of start switches, each for inititating the operation of said clock means for timing one of said different events and for interrupting the timing of the other of said two different events;

display means coupled to said clock means for displaying the time for each of said two events;

counter means coupled to said respective ones of said pair of switches for counting the number of operations of respective ones of said pair of start switches; and means coupling said clock means to said display means for normally displaying time in one set of units and means responsive to a predetermined time count by said clock means for displaying the time count in shorter units of time;

wherein said clock means comprises a pair of individual clocks and each of said pair of start switches is coupled to said individual clocks to start one of said individual clocks to start one of said individual clocks while simultaneously stopping the other of said individual clocks;

including means responsive to one of said individual clocks reaching a final time value for automatically resetting said clock to an initial value;

including decision means responsive to the reaching of a final value for resetting said clock means to a second control value when the original time value was other than a predetermined value.

5. The combination in accordance with claim 4 wherein said predetermined value is one hour.

6. The combination in accordance with claim 4 wherein said decision means is responsive to a different initial time value for resetting said clock means to a different reset time value.

7. The combination in accordance with claim 4 wherein said initial value is 30 minutes and said predetermined reset time value is 30 minutes.

8. A game timing device for simultaneously timing events for two players comprising;

clock means for measuring the time of two different events;

a pair of start switches, each for initiating the operation of said clock means for timing one of said different events and for interrupting the timing of the other of said two different events;

display means coupled to said clock means for displaying the time for each of said two events;

counter means coupled to said respective ones of said pair of switches for counting the number of operations of respective ones of said pair of start switches; and means coupling said clock means to said display means for normally displaying time in one set of units and means responsive to a predetermined time count by said clock means for displaying the time count in shorter units of time;

including switch means for interrupting the display of time on said display means and for temporarily displaying the count of said counter means.

9. A chess clock comprising:

a time base means;

a first up/down counter register means coupled to the time base means for up counting and temporarily maintaining a first game time period value, and, down counting from the first game time period value while maintaining a first current remaining move time value, the time base means causing the first up/down counter register means to down count in discrete periods of time substantially equal to one of the following: minutes and seconds;

a second up/down counter register means for coupling to the time base means to do the following: up counting and temporarily maintaining a second game time period value, and, down counting from the second game time period value while maintaining from the second game time period value a second current remaining time value, the time base means causing the second up/down counter register means to down count in discrete periods of time substantially equal to one of the following: minute periods and second periods;

a first start/stop switch means for preventing the first time base means from causing the down counting from the first game time period value in the first up/down counter register means and for enabling the second time base means to cause the down counting from the second game time period value in the second up/down counter register means responsive to being switched by a first chess player;

a second start/stop switch means for preventing the second time base means from causing the down counting from the second game period value in the second up/down counter register means and for enabling the first time base means to cause the down counting from the first game time period value in the first up/down counter register means responsive to being switched by a second chess player;

a means for counting a first and second tally value, the first tally value representing a current total number of switchings of the first start/stop switch means, the second tally value representing a current total number of switchings of the second start/stop switch means;

a set/advance switch means for causing the first and second up/down counter register means to up count to a desired game period value;

digital display means for temporarily displaying the digits of the game period value and for selectively displaying digits of the first and second current remaining move time values, and digits of first and second tally values.

10. The chess clock in accordance with claim 9 further including means for causing the down counting in the first and second up/down counter register means to down count in discrete second time periods when the selected game time period value is at most ten minutes.

11. The chess clock in accordance with claim 9 further including means for audiably indicating the switching of the first and second start/stop switching means.

12. The chess clock in accordance with claim 9 in which the digital display means comprises a liquid crystal digital display.

13. The combination in accordance with claim 9 including STOP switch means operative during play to temporarily disabling said display and for holding said first and second up/down counter register means at the current count when said STOP switch is actuated for greater than a predetermined time.

14. The combination in accordance with claim 9 in which said STOP switch is operative to hold said first and second tally counting means at the current count whenever said STOP switch is actuated for greater than a predetermined period of time.

* * * * *